US010286710B2

(12) United States Patent
Niu et al.

(10) Patent No.: US 10,286,710 B2
(45) Date of Patent: May 14, 2019

(54) MEDIA SHEET

(71) Applicant: Hewlett-Packard Development Company, L.P., Fort Collins, CO (US)

(72) Inventors: Bor-Jiunn Niu, San Diego, CA (US); Tao Chen, San Diego, CA (US); Christopher Arend Toles, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 273 days.

(21) Appl. No.: 15/038,679

(22) PCT Filed: Dec. 20, 2013

(86) PCT No.: PCT/US2013/077053

§ 371 (c)(1),
(2) Date: May 23, 2016

(87) PCT Pub. No.: WO2015/094352

PCT Pub. Date: Jun. 25, 2015

(65) Prior Publication Data

US 2016/0288558 A1 Oct. 6, 2016

(51) Int. Cl.
*B41M 5/50* (2006.01)
*D21H 19/10* (2006.01)

(52) U.S. Cl.
CPC ..... *B41M 5/506* (2013.01); *D21H 19/10* (2013.01); *B41M 2205/38* (2013.01)

(58) Field of Classification Search
None
See application file for complete search history.

(56) References Cited

U.S. PATENT DOCUMENTS 5,985,453 A 11/1999 Moriya et al.
6,197,409 B1 3/2001 Bodager et al.
(Continued)

FOREIGN PATENT DOCUMENTS

| | | |
|---|---|---|
| EP | 1095784 | 5/2001 |
| JP | S62231788 | 10/1987 |
| JP | 2010149339 | 7/2010 |

OTHER PUBLICATIONS

International Search Report dated Sep. 18, 2014 for PCT/US2013/077053, Applicant Hewlett-Packard Development Company, L.P.
(Continued)

*Primary Examiner* — Shamim Ahmed
*Assistant Examiner* — Bradford M Gates
(74) *Attorney, Agent, or Firm* — Thorpe North & Western LLP

(57) ABSTRACT

The present disclosure provides recording media and methods. In one example, a light weight media sheet for high speed printing can comprise a paper substrate having a basis weight of less than 100 gsm; a first flatness control layer applied directly to a first side of the paper substrate, the first flatness control layer having a coating weight from 1 to 15 gsm, wherein the first flatness control layer comprises a polymer selected from the group consisting of a polyvinyl alcohol, a polyamide, a polyimide, a polyethylene oxide, a polyvinyl pyrrolidone, a cellulose, a starch, an acrylate, copolymers thereof, and mixtures thereof; and a first ink-receiving layer applied directly to the first flatness control layer, the first ink-receiving layer having a coating weight from 1 to 40 gsm, where the light weight media sheet has a total basis weight from 40 to 150 gsm.

20 Claims, 2 Drawing Sheets

(56) References Cited

U.S. PATENT DOCUMENTS

| | | | | |
|---|---|---|---|---|
| 6,620,470 | B2 | 9/2003 | Nojima et al. | |
| 7,370,959 | B2 | 5/2008 | Kobayashi et al. | |
| 2002/0012774 | A1 | 1/2002 | Neithardt et al. | |
| 2008/0069981 | A1 | 3/2008 | Ming | |
| 2008/0241483 | A1* | 10/2008 | Verhoeven | D21H 19/44 428/172 |
| 2009/0020247 | A1 | 1/2009 | Swerin et al. | |
| 2010/0086709 | A1* | 4/2010 | Huang | D21H 21/16 428/32.18 |
| 2012/0012264 | A1 | 1/2012 | Zhou et al. | |
| 2012/0114880 | A1 | 5/2012 | Nagoshi et al. | |
| 2012/0194625 | A1 | 8/2012 | Niu et al. | |
| 2013/0257990 | A1 | 10/2013 | Swei | |

OTHER PUBLICATIONS

European Search Report dated Jan. 9, 2017 for PCT/US2013/077053, Applicant Hewlett-Packard Development Company, L.P.

* cited by examiner

MEDIA SHEET

BACKGROUND

There are a variety of methods for commercial high speed printing to produce large quantities of print material, such as books, magazines, newsprints, and brochures. In the past, traditional analog printers, such as web fed offset and gravure contact printers, were the most common type of printers for such commercial applications. In recent years, digital web fed high speed inkjet non-contact printers have become more prevalent due to 100% variable print content and multi-color printing at a relatively low cost to consumers.

While paper media typically used for more traditional analog printers can perform somewhat acceptably on high speed web fed inkjet (non-contact) printing devices, such paper media are subject to problems relating to one or more of cockle, curl, wrinkle, crease, and misregistration and other similar problems, which can detrimentally impact productivity, product quality, and cost. For example, inkjet printing has a much higher moisture level than offset and gravure printing due to the colored pigments of the inkjet ink being applied to the paper media using a generally water based liquid vehicle, which will cause non-uniform hygro-expansion that appears to be related to cockle/waviness and misregistration issues. Cockle refers to a small scale expansion in paper fiber width when wetted with water, for example from water-based inkjet inks.

As such, research and development of media continue to be sought.

BRIEF DESCRIPTION OF THE DRAWINGS

Additional features and advantages of the disclosure will be apparent from the detailed description which follows, taken in conjunction with the accompanying drawings, which together illustrate, by way of example, features of the technology; and, wherein.

Figure 1:
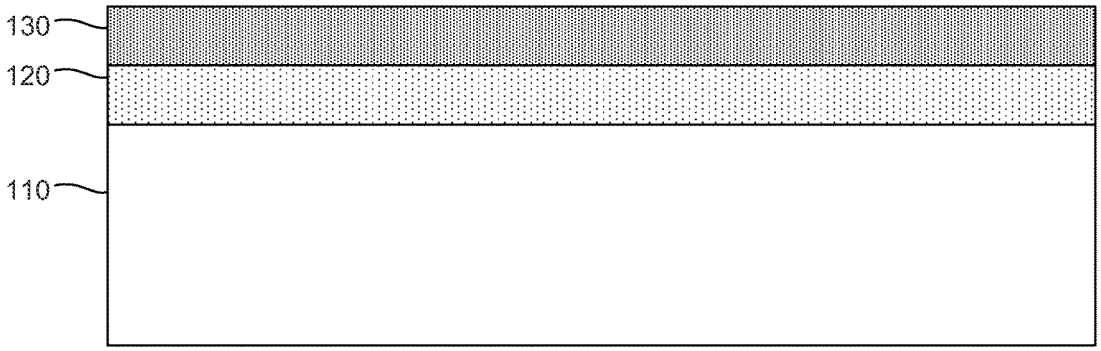
FIG. 1 is a cross-sectional side view of a media sheet in accordance with an example of the present disclosure.

Reference will now be made to the exemplary embodiments illustrated, and specific language will be used herein to describe the same. It will nevertheless be understood that no limitation of the scope of the technology is thereby intended.

DETAILED DESCRIPTION

In accordance with examples of the present disclosure, light weight media sheets having a flatness control layer coated thereon can overcome problems of curl or cockling found in high speed printing applications, e.g. Hewlett Packard Web Press Printing. Notably, utilizing a flatness control layer interposed between a substrate and ink-receiving layer can provide recording media having improved flatness.

Examples in accordance with the technology described herein are directed to a media that is more useful in digital high speed inkjet web press printing. The media can be a light weight, coated, paper-based media in that the media comprises a paper base and a coating on one or both surfaces of the paper base that facilitates image formation on the media. The media according to the technology herein exhibits improved runnability during printing and finishing and improved flatness of final output.

The use of the flatness control layer that increases the water holding time of the media can prevent or minimize the migration of water and/or solvents into the substrate. As such, the water and/or other solvents from printed inks (and their respective ink vehicles) reside closer to the surface of the media, and therefore, can more effectively evaporate during printing and subsequent processing.

Generally, recording media can have a variety of layers including extruded layers, curl control layers, barrier layers, imaging layers, etc., and such layers often use costly additives to provide acceptable media sheets for printing. However, utilizing a flatness control layer interposed between a paper substrate and ink-receiving layer as described herein can eliminate the need for some layers, can eliminate costly additives, and/or can eliminate the amounts of materials needed in the media sheet.

With the above in mind, a light weight media sheer for high speed printing can comprise a paper substrate having a basis weight of less than 100 gram per square meter (gsm). The media can also include a first flatness control layer applied directly to a first side of the paper substrate, the flatness control layer having a coating weight from 1 to 15 gsm, wherein the first flatness control layer comprises a polymer selected from the group of a polyvinyl alcohol, a polyamide, a polyimide, a polyethylene oxide, a polyvinyl pyrrolidone, a cellulose, a starch, an acrylate, copolymers thereof, and mixtures thereof. Additionally, the light weight media sheet can also include a first ink-receiving layer applied directly to the first flatness control layer, the first ink-receiving layer having a coating weight from 1 to 40 gsm. Generally, the light weight media sheet can have a total basis weight from 40 to 150 gsm.

In one example, the media sheet can further comprise a second flatness control layer applied directly to a second side of the paper substrate, and can have a coating weight from 1 to 15 gsm. In one aspect, the media sheet can further comprise a second ink-receiving layer applied directly to the second flatness control layer, and can have a coating weight from 1 to 40 gsm. Notably, such layers can be the same or different including having the same materials, different materials, the same amounts of the same materials, different amounts of the same materials, etc. In one example, the first flatness control layer can contain the same components as the second flatness control layer. In another example, the first ink-receiving layer can contain the same components as the second ink-receiving layer.

Generally, as mentioned, the present media sheets have one or more flatness control layer. In one example, the flatness control layer can comprise a polymer including a polyvinyl alcohol (e.g., polyvinyl alcohol, a polyvinyl alcohol copolymer, a cationic polyvinyl alcohol, a polyvinyl alcohol-polyethylene oxide copolymer, a modified polyvinyl alcohol); a polyamide (e.g., a polyamide copolymer or homopolymer); a polyimide (e.g., polyimide copolymer or homopolymer); a polyethylene oxide (e.g., a polyethylene oxide copolymer or homopolymer); a polyvinyl pyrrolidone (e.g., a polyvinylpolypyrrolidone copolymer or homopolymer); a cellulose (e.g., cellulose or modified cellulose); a starch (e.g., cationic starch); an acrylate (e.g., acrylate copolymer or homopolymer); etc. In one aspect, the polymer can be a polyvinyl alcohol. In another aspect, the polymer can be a polyvinyl alcohol modified with a reactive acetacetyl group. In another example, the polymer can be blend of a polyvinyl alcohol and a polyamide. In still another aspect, the polymer can be a blend of a polyamide and a crosslinked polyvinylpolypyrrolidone.

Generally, the flatness control layer(s) discussed herein are present in the media sheet at a coating weight from 1 to 15 gsm. In one example, the coating weight can be from 1 to 10 gsm, and in one aspect, from 1 to 5 gsm. In one example, the flatness control layer can be a hydrophobic polymeric layer.

Generally, the present media sheets have at least one ink-receiving layer. The ink-receiving layer can include fixers, inorganic salts, polymers, optical brightening agents, defoamers, viscosity modifiers, organic reagents, inorganic pigment, organic pigment, etc. Generally, the ink-receiving layers discussed herein are present in the media sheet at a coating weight from 1 to 40 gsm. In one example, the coating weight can be from 1 to 20 gsm, and in one aspect, from 5 to 15 gsm.

As discussed herein, the present media sheets achieve a flatness after high speed printing without the need of expensive additives, curl control layers, or moisture barrier layers. As such, in one example, the flatness control layer can exclude additives and surface sizing agents including calcium carbonate, zeolite, silica, talc, alumina, aluminum trihydrate (ATH), calcium silicate, kaolin, calcined clay, starches and starch derivatives; carboxymethylcellulose (CMC); methyl cellulose; alginates; waxes; wax emulsions; alkylketene dimer (AKD); alkyl succinic anhydride (ASA); alkenyl ketene dimer emulsion (AnKD); emulsions of ASA or AKD with cationic starch; ASA incorporating alum. Additionally, in another example, the present media sheets can exclude curl layers or moisture barrier layers including, in one aspect, extruded hydrophobic polymer layers such as polyethylene layers.

Generally, the present media sheets comprise a paper substrate. In one example, the paper substrate can be a wood fiber substrate. Generally, the paper substrate is a light weight paper substrate having a basis weight of 30 gsm to 100 gsm. In one example, the light weight paper substrate can have a basis weight of 35 gsm to 80 gsm, and in one aspect, can have a basis weight of 40 gsm to 70 gsm. In one specific aspect, the basis weight can be from 10 gsm to 50 gsm. Additionally, while the present media sheets generally have a total basis weight from 40 to 150 gsm, such sheets can have lighter weights. In one example, the total basis weight can be from 40 to 120 gsm, and in one aspect, can be from 60 to 90 gsm.

As discussed herein, the present media sheets have exceptional flatness even when used in high speed printing applications, such as Hewlett Packard's Web Press printing technologies. Such high speed printing technologies can include those generally having a processing speed from 200 ft/min to 800 ft/min. Under such conditions, the present flatness can be quantitatively measured using an amplitude parameter, a roughness parameter, and a water holding time. Such parameters are used to provide an objective independent measurement that directly correlates to the flatness of the present media sheets. Amplitude parameter is a calculation based on the peak heights on the surface of the paper across a profile line. Roughness parameter is a root mean squared calculation of the profile line. Water holding time measures the ability of the paper to hold water on the surface thereby minimizing the water uptake by the paper substrate. As such, the amplitude parameter and the roughness parameter are measurements based on the physical structure on the surface of the paper. Water holding time is a measurement of the media sheet's ability to "hold water" on the surface, thereby allowing water/solvents to evaporate more quickly, thereby reducing curl and cockle due to the presence of these liquids in the paper substrate. These terms are defined hereinafter including the measurements to obtain them.

In one example, the light weight media sheets can have an amplitude parameter of less than 1.0. In one aspect, the amplitude parameter can be less than 0.60, and in one specific aspect, less than 0.3. In one example, the light weight media sheets can have a roughness parameter of less than 0.50. In one aspect, the roughness parameter can be less than 0.40, and in one specific aspect, less than 0.30. In one example, the light weight media sheets can have a water holding time of at least 30 seconds. In one aspect, water holding time can be at least 60 seconds, and in one specific aspect, can be at least 100 seconds.

The present media sheets can be used in conjunction with printing inks. The recording media can be applied in multiple imaging systems, non-limiting examples of which include thermal or piezo inkjet, dye-sub, thermal transfer, electrostatic, liquid electrophotographic printing (LEP), etc. In one aspect, the media sheets can be used with ink-jet inks comprising pigments and/or dyes in an ink vehicle. Typical ink vehicle formulations can include water, and can further include co-solvents present in total at from 0.1 wt % to 30 wt %, depending on the jetting architecture, though amounts outside of this range can also be used. Further, non-ionic, cationic, and/or anionic surfactants can be present, ranging from 0.01 wt % to 10 wt %. In addition to the colorant, the balance of the formulation can be purified water, or other vehicle components, such as biocides, viscosity modifiers, materials for pH adjustment, sequestering agents, preservatives, and the like.

Figure 2:
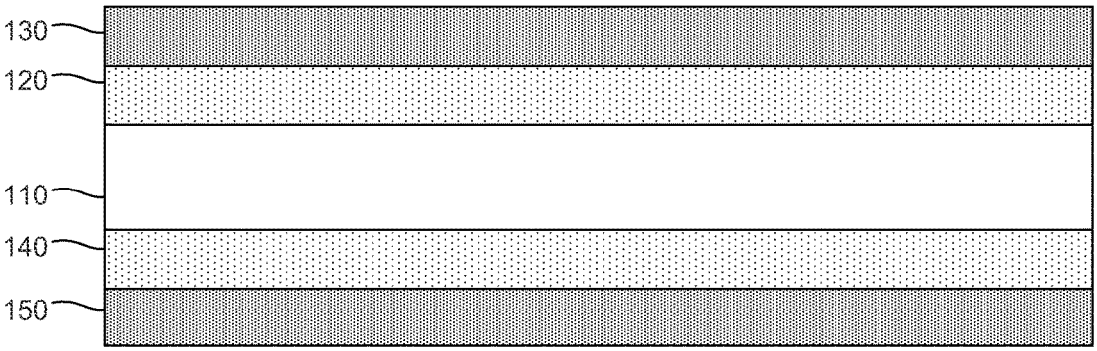
FIG. 2 is a cross-sectional side view of a media sheet in accordance with an example of the present disclosure.

Turning now to FIGS. 1-2, a media sheet can include a paper substrate 110 with a first flatness control layer 120 directly applied thereto and a first ink-receiving layer 130 directly applied to the first flatness control layer (FIG. 1). The media sheet can further comprise a second flatness control layer 140 directly applied to the paper substrate and a second ink-receiving layer 150 directly applied to the second flatness control layer (FIG. 2). While the present media sheet has been illustrated in FIGS. 1-2, such examples are not intended to be particularly limiting as other configurations are contemplated herein.

Figure 3:
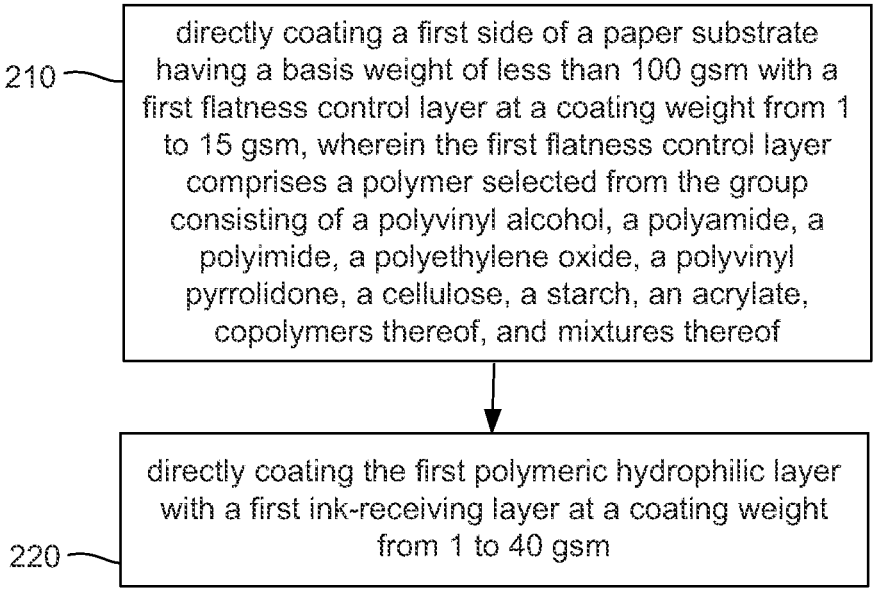
FIG. 3 is a flow chart of a method in accordance with an example of the present disclosure.

In addition to the recording media described herein, the present disclosure provides for methods for manufacturing lightweight media sheets. Turning now to FIG. 3, a method of manufacturing a light weight media sheet can comprise directly coating 210 a first side of a paper substrate having a basis weight of 10 to 100 gsm with a first flatness control layer at a coating weight from 1 to 15 gsm; and directly coating 220 the first flatness control layer with a first ink-receiving layer at a coating weight from 1 to 40 gsm, where the light weight media sheet has a total basis weight from 40 to 150 gsm. Additionally, a second flatness control layer and second ink-receiving layer can be applied in the same manner, such as to an opposite side of the paper substrate.

Figure 4:
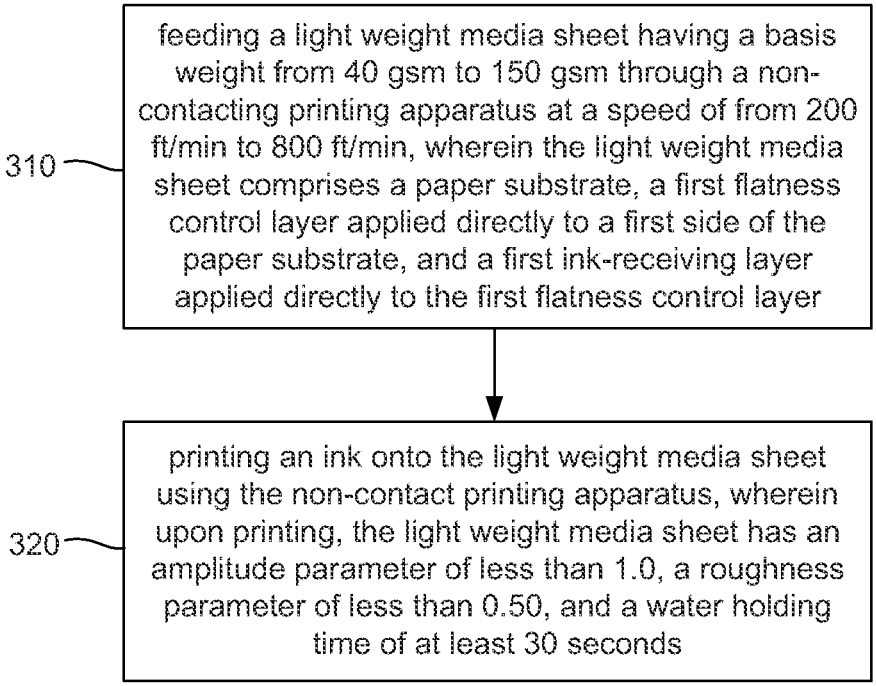
FIG. 4 is a flow chart of another method in accordance with an example of the present disclosure.

In another example, as shown in FIG. 4, a method of high speed printing can comprise feeding 310 a light weight media sheet having a basis weight from 40 gsm to 150 gsm through a non-contacting printing apparatus at a speed of from 200 ft/min to 800 ft/min. The light weight media sheet can be that as described previously. The method can also include the step of printing 320 an ink onto the light weight media sheet using the non-contact printing apparatus, wherein upon printing, the light weight media sheet has an amplitude parameter of less than 1.0, a roughness parameter of less than 0.50, and a water holding time of at least 30 seconds.

It is noted that when discussing the compositions and methods, each of these discussions can be considered applicable to each of these embodiments, whether or not they are explicitly discussed in the context of that embodiment. Thus, for example, in discussing a flatness control layer used in a light weight media sheet, such a flatness control layer can also be used in a method of manufacturing a light weight media sheet, and vice versa. Thus, the disclosure herein describing the media sheets per se also related directly to the present methods.

Regarding the present method steps, such steps can be performed in a number of sequences and are not intended to be limited to the order written. For example, the second flatness control layer can be applied before the first flatness control layer, and vice versa. Additionally, it is noted that any and all combinations of such steps or individual step may be performed sequentially or simultaneously. For example, coating the paper substrate with the first flatness control layer and the second flatness control layer may be performed sequentially or may be performed simultaneously.

Additionally, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is be noted that, as used in this specification and the appended claims, the singular forms "a," "an," and "the" include plural referents unless the context clearly dictates otherwise.

As used herein, the term "wood fiber" refers to cellulosic fibers and other known paper fibers including hardwood pulps and softwood pulps as defined herein. As used herein, the term "hardwood fiber" or "hardwood pulps" refers to fibrous pulp derived from the woody substance of deciduous trees (angiosperms) such as aspen, birch, oak, beech, maple, and eucalyptus. As used herein, the term "softwood fiber" or "softwood pulps" refers to fibrous pulps derived from the woody substance of coniferous trees (gymnosperms) such as varieties of fir, spruce, and pine, as for example loblolly pine, slash pine, Colorado spruce, balsam fir and Douglas fir.

As used herein, "amplitude parameter" refers to the calculation of average height of three highest peaks from a profile line measured by Industrial Vision Camera IVC-3D Laser Profiler. The Laser Profiler generates a profile line by measuring the Z direction height change from cross direction (CD) of a media sheet.

As used herein, "roughness parameter" refers to the root mean squared roughness parameter calculated from the profile line measured by Industrial Vision Camera IVC-3D Laser Profiler. The Laser Profiler generates a profile line by measuring the Z direction height change from cross direction (CD) of a media sheet.

As used herein, "water holding time" refers to the amount of time it takes for a formic acid solution dyed green to pass through the paper as measured by a Hercules Sizing Tester as per TAPPI Test method T 530 om-2 (current version as of 2013).

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

EXAMPLES

The following examples illustrate some embodiments of the present recording media and methods that are presently known. However, it is to be understood that the following are only exemplary or illustrative of the application of the principles of the present recording media and methods. Numerous modifications and alternative examples may be devised by those skilled in the art without departing from the spirit and scope of the present compositions and methods. The appended claims are intended to cover such modifications and arrangements. Thus, while the present recording media and methods have been described above with particularity, the following examples provide further detail in connection with what are presently deemed to be the acceptable embodiments.

Example 1

Media Sheets

The present media sheets were generally prepared by coating various paper substrates with various flatness control layers, each combination having the same ink-receiving layer. The paper substrate details are listed in Table 1. The flatness control layers were prepared by combining the components in the amounts according to Table 2. The ink-receiving layer was prepared by combining the components in the amounts according to Table 3. The materials and coating weights for each media sheet are shown in Table 4.

TABLE 1

| GB base paper properties | | GB 65 | GB 80 |
|---|---|---|---|
| Dry weight | $g/m^2$ | 37.6 | 48.3 |
| Moisture | % | 3.2 | 3.2 |
| Basis weight | $g/m^2$ | 38.8 | 49.9 |
| Ash content | % | 12 | 12 |
| Thickness | um | 66 | 85 |
| Density | $kg/m^3$ | 595 | 600 |
| Tensile strength, MD | kN/m | 2.8 | 3.5 |
| Tear strength, CD | mN | 305 | 380 |
| Tear strength, MD | mN | 200 | 240 |
| Elongation, MD | % | 1.3 | 1.5 |
| Dimension stability | % | 0.82 | 0.8 |
| Formation | % | 7 | 9 |
| Porosity | ml/min | 155 | 135 |
| Bendtsen roughness, TS | ml/min | 250 | 320 |
| Bendtsen roughness, WS | ml/min | 325 | 395 |
| Brightness (D65/10) | % | 75 | 75.5 |
| Opacity | % | 84 | 90 |
| L* | % | 91 | 91 |
| a* | % | −0.3 | −0.3 |
| b* | % | 1 | 1 |
| Chemical pulp | % | 35 | 32 |
| GW | % | 65 | 68 |

TABLE 2

| Flatness Control Layer (PL#) | First Polymer (dry wt %) | Second Polymer (dry wt %) | Cross-linker (dry wt %) |
|---|---|---|---|
| 1 | Amres 1110E, a polyamide polymer, available from Georgia-Pacific Corporation (23) | Mowiol ® 4-98, a polyvinyl alcohol, available from Clariant (70) | Boric Acid (7) |
| 2 | Amres 1110E, a polyamide polymer, available from Georgia-Pacific Corporation (50) | Viviprint ™ 540, a crosslinked poly-vinylpolypyrrolidone, available from Ashland (50) | N/A |
| 3 | Z-200, a modified PVOH containing a reactive acetacetyl group, available from Nippon Gohsei (100) | N/A | N/A |
| 4 | Z-100, a modified PVOH containing a reactive acetacetyl group, available from Nippon Gohsei (100) | N/A | N/A |

TABLE 3

| Ink-Receiving Layer (IRL) | Dry Parts by Weight (based on Inorganic Pigment) |
|---|---|
| Modified Calcium Carbonate | 10 |
| Ground Calcium Carbonate | 90 |
| Styrene-butadiene Latex | 7 |
| Mowiol ® 4-98 (Polyvinyl Alcohol) | 4 |
| Calcium Chloride (CaCl2) | 4 |
| Rhoplex ® AC22 (Defoamer from Dow Chemical) | 0.35 |
| Wax Additive | 1.8 |
| Dye | 0.005 |
| Optical Brightening Agent | 0.5 |

TABLE 4

| Media Sheet | Paper Substrate (gsm) | Flatness Control Layer (gsm) | Ink-Receiving Layer (gsm) |
|---|---|---|---|
| Control #1 | GB 65 (38.8) | N/A | IRL (7) |
| 1 | GB 65 (38.8) | PL 1 (3) | IRL (7) |
| 2 | GB 65 (38.8) | PL2 (3) | IRL (7) |
| Control #2 | GB 80 (49.9) | N/A | IRL (7) |
| 3 | GB 80 (49.9) | PL 1 (3) | IRL (7) |
| 4 | GB 80 (49.9) | PL2 (3) | IRL (7) |
| 5 | GB 80 (49.9) | PL3 (3) | IRL (7) |
| 6 | GB 80 (49.9) | PL4 (3) | IRL (7) |

Example 2

Data

The media sheets of Table 4 were printed on a Hewlett Packard CM8060 Color MFP with Edgeline Technology with an A50 ink, available from Hewlett Packard, at a coverage of 60% and tested for amplitude parameter, roughness parameter, and water holding time using an Industrial Vision Camera IVC-3D Laser Profiler. The results are listed in Table 5.

TABLE 5

| Media Sheet | Amplitude Parameter | Roughness Parameter | Water Holding Time |
|---|---|---|---|
| Control #1 | 0.94 | 0.81 | 0 |
| 1 | 0.79 | 0.51 | 34.2 |
| 2 | 0.59 | 0.54 | 39.5 |
| Control #2 | 0.73 | 0.44 | 0 |
| 3 | 0.37 | 0.26 | 117 |
| 4 | 0.66 | 0.38 | 119 |
| 5 | 0.61 | 0.39 | 146 |
| 6 | 0.55 | 0.33 | 13 |

As shown in Table 5, the present media sheets had better amplitude parameters, roughness parameters, and water holding times compared to the control sheets. Notably, the amplitude parameter and the roughness parameter were reduced for the present media sheets as compared to the control sheets. A lower value for these parameters indicates that the surface of the sheets is flatter; i.e., the average peak heights are smaller. Also, the water holding time was increased for the present media sheets as compared to the control sheets. A high value for the water holding time indicates that the paper was able to retain the water/solvents on the surface of the paper better. As such, the water/solvents were able to evaporate quicker allowing less water/solvents to absorb into the paper substrate. Also notably, media sheets having higher water holding times were flatter as shown by the amplitude and roughness parameters.

Furthermore, uncoated paper substrates having basis weights of greater than about 100 gsm are not as susceptible to curl and cockle because they are more substantial in their overall weight. Additionally, coated papers having basis weights of greater than about 150 gsm also do not typically exhibit excessive curl and cockle. Conversely, with thinner papers such as those shown above, reduced curl and cockle can be achieved even when the base paper and/or the total coated media thicknesses are particularly thin.

While the disclosure has been described with reference to certain embodiments, those skilled in the art will appreciate that various modifications, changes, omissions, and substitutions can be made without departing from the spirit of the disclosure. It is intended, therefore, that the present disclosure be limited only by the scope of the following claims.

What is claimed is:

1. A light weight media sheet for high speed printing, comprising:

a paper substrate having a basis weight of less than 100 gsm;

a first flatness control layer applied directly to a first side of the paper substrate, the first flatness control layer having a coating weight from 1 to 15 gsm, wherein the first flatness control layer comprises a polymer selected from the group consisting of a blend of a polyvinyl alcohol and a polyamide, a blend of a polyamide and a crosslinked polyvinylpolypyrrolidone, and a polyvinyl alcohol modified with a reactive acetacetyl group; and a first ink-receiving layer applied directly to the first flatness control layer, the first ink-receiving layer having a coating weight from 1 to 40 gsm, wherein the light weight media sheet has a total basis weight from 40 to 150 and a water holding time of at least 30 seconds.

2. The light weight media sheet of claim 1, further comprising a second flatness control layer applied directly to a second side of the paper substrate, the second flatness control layer having a coating weight from 1 to 15 gsm.

3. The light weight media sheet of claim 2, further comprising a second ink-receiving layer applied directly to the second flatness control layer, the second ink-receiving layer having a coating weight from 1 to 40 gsm.

4. The light weight media sheet of claim 3, wherein the first flatness control layer contains the same components as the second flatness control layer.

5. The light weight media sheet of claim 3, wherein the first ink-receiving layer contains the same components as the second ink-receiving layer.

6. The light weight media sheet of claim 1, wherein the ink-receiving layer comprises fixers, inorganic salts, polymers, optical brightening agents, defoamers, viscosity modifiers, or organic reagents.

7. The light weight media sheet of claim 1, wherein the paper substrate is a wood fiber substrate.

8. The light weight media sheet of claim 1, wherein the light weight media sheet has an amplitude parameter of less than 1.0 and a roughness parameter of less than 0.50.

9. The light weight media sheet of claim 1, wherein the paper substrate has a basis weight of 10 gsm to 50 gsm.

10. The light weight media sheet of claim 1, wherein the paper substrate has a basis weight of 30 to 40 gsm.

11. A method of manufacturing a light weight media sheet, comprising:

directly coating a first side of a paper substrate having a basis weight of less than 100 gsm with a first flatness control layer at a coating weight from 1 to 15 gsm, wherein the first flatness control layer comprises a polymer selected from the group consisting of a blend of a polyvinyl alcohol and a polyamide, a blend of a polyamide and a crosslinked polyvinylpolypyrrolidone, and a polyvinyl alcohol modified with a reactive acetacetyl group; and directly coating the first flatness control layer with a first ink-receiving layer at a coating weight from 1 to 40 gsm, wherein the light weight media sheet has a total basis weight from 40 to 150 gsm and a water holding time of at least 30 seconds.

12. The method of claim 11, further comprising directly coating a second side of a paper substrate with a second flatness control layer at a coating weight from 1 to 15 gsm, and directly coating the second flatness control layer with a second ink-receiving layer at a coating weight from 1 to 40 gsm.

13. The method of claim 12, further comprising directly coating a second ink-receiving layer to the second flatness control layer, the second ink-receiving layer having a coating weight from 1 to 40 gsm.

14. The method of claim 11, wherein the light weight media sheet has an amplitude parameter of less than 1.0 and a roughness parameter of less than 0.50.

15. The method of claim 14, wherein the first flatness control layer contains the same components as the second flatness control layer.

16. The method of claim 14, wherein the first ink-receiving layer contains the same components as the second ink-receiving layer.

17. The method of claim 11, wherein the paper substrate has a basis weight of 10 gsm to 50 gsm.

18. The method of claim 11, wherein the first ink-receiving layer comprises fixers, inorganic salts, polymers, optical brightening agents, defoamers, viscosity modifiers, or organic reagents.

19. The method of claim 11, wherein the paper substrate is a wood fiber substrate.

20. A method of high speed printing, comprising:

feeding a light weight media sheet having a basis weight from 40 gsm to 150 gsm through a non-contacting printing apparatus at a speed of from 200 ft/min to 800 ft/min, wherein the light weight media sheet comprises a paper substrate, a first flatness control layer applied directly to a first side of the paper substrate, and a first ink-receiving layer applied directly to the first flatness control layer; and printing an ink onto the light weight media sheet using the non-contact printing apparatus, wherein upon printing, the light weight media sheet has an amplitude parameter of less than 1.0, a roughness parameter of less than 0.50, and a water holding time of at least 30 seconds.

* * * * *